US009563170B2

(12) United States Patent
Kitamura

(10) Patent No.: US 9,563,170 B2
(45) Date of Patent: Feb. 7, 2017

(54) IMAGE FORMING APPARATUS CONFIGURED TO USE A COMMON DRIVING SOURCE FOR IMAGE BEARING MEMBERS

(71) Applicant: CANON KABUSHIKI KAISHA, Tokyo (JP)

(72) Inventor: Takuya Kitamura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/019,302

(22) Filed: Feb. 9, 2016

(65) Prior Publication Data

US 2016/0231693 A1 Aug. 11, 2016

(30) Foreign Application Priority Data

Feb. 10, 2015 (JP) ..... 2015-024791
Jan. 14, 2016 (JP) ..... 2016-005564

(51) Int. Cl.

*G03G 15/00* (2006.01)
*G03G 21/16* (2006.01)
*G03G 15/01* (2006.01)
*G03G 21/18* (2006.01)

(52) U.S. Cl.

CPC ..... *G03G 21/1676* (2013.01); *G03G 15/0121* (2013.01); *G03G 21/1647* (2013.01); *G03G 21/1825* (2013.01); *G03G 2215/0141* (2013.01)

(58) Field of Classification Search

CPC ..... G03G 15/0121; G03G 21/1676; G03G 2215/018
USPC ..... 399/43, 53, 228
See application file for complete search history.

(56) References Cited

U.S. PATENT DOCUMENTS

| | | | | |
|---|---|---|---|---|
| 7,580,654 | B2 | 8/2009 | Okubo | |
| 8,068,752 | B2 | 11/2011 | Sugiyama | |
| 2010/0124427 | A1* | 5/2010 | Sugiyama | G03G 15/0813 399/53 |
| 2012/0014717 | A1* | 1/2012 | Sugiyama | G03G 15/0121 399/228 |
| 2014/0314431 | A1* | 10/2014 | Morihara | G03G 15/0136 399/228 X |

(Continued)

FOREIGN PATENT DOCUMENTS

| | | | |
|---|---|---|---|
| JP | 2001318506 | A | 11/2001 |
| JP | 2003215876 | A | 7/2003 |

(Continued)

*Primary Examiner* — Sophia S Chen
(74) *Attorney, Agent, or Firm* — Rossi, Kimms & McDowell LLP

(57) ABSTRACT

An image forming apparatus includes image bearing members, a latent image forming portion, developing units each including a developing member, a movable member, a common driving source, a contact-and-separation unit, and a control unit. The image forming apparatus is capable of forming the images in an operation in an image forming mode. After end of the latent image formation on one of the image bearing members on which latent image formation is finally started and before end of transfer of an associated image from the one image bearing member, the control unit outputs a spacing signal for spacing associated developing members from the other image bearing members, during the image formation in the operation in the mode.

20 Claims, 7 Drawing Sheets

(56) References Cited

U.S. PATENT DOCUMENTS

2014/0369704 A1* 12/2014 Matsumoto ..... G03G 15/043
399/53

FOREIGN PATENT DOCUMENTS

| | | | |
|---|---|---|---|
| JP | 2010140016 | A | 6/2010 |
| JP | 2011150376 | A | 8/2011 |
| JP | 4950595 | B2 | 6/2012 |
| JP | 2014115340 | A | 6/2014 |
| JP | 5665311 | B2 | 2/2015 |

* cited by examiner

IMAGE FORMING APPARATUS CONFIGURED TO USE A COMMON DRIVING SOURCE FOR IMAGE BEARING MEMBERS

FIELD OF THE INVENTION AND RELATED ART

The present invention relates to an image forming apparatus, such as a copying machine, a printer or a facsimile machine, using an electrophotographic process or an electrostatic recording process.

Conventionally, for example, as a latent image developing type of an image forming apparatus, such as the copying machine, the printer or the facsimile machine, using the electrophotographic process, a contact development type image forming apparatus development is effected in a contact state between an image bearing member and a developing member is used. Description will be made using a photosensitive drum as the image bearing member and using a developing roller as the developing member.

In the image forming apparatus employing the contact development type, there arises a problem that deterioration of both of the photosensitive drum and the developing roller due to abrasion (wearing) of the photosensitive drum and the developing roller is liable to generate. In the contact development type, the photosensitive drum and the developing roller contact a toner, so that compared with a non-contact development type, a physical stress exerted on the toner is large and therefore there is a problem that a degree of deterioration of the toner is liable to increase.

In order to solve the problems, Japanese Laid-Open Patent Application (JP-A) 2010-140016 has proposed that the photosensitive drum and the developing roller are spaced in the case where there is a need to increase a sheet (paper) interval when images are continuously formed on a plurality of recording materials.

Further, JP-A 2001-318506 has proposed that the photosensitive drum and the developing roller are contacted only a period in which a latent image on the photosensitive drum is developed in a constitution including image forming units for a plurality of colors.

However, the conventional constitutions involves the following problems.

The constitution of JP-A 2010-140016 is effective in the case where there is a need to increase the sheet interval when the images are continuously formed. However, in the case of single image formation or in the case where there is no need to increase the sheet interval even when the images are continuously formed, an effect of reducing a contact opportunity between the photosensitive drum and the developing roller cannot be obtained.

The constitution of JP-A 2010-318506 causes the following problem in the case where a constitution in which a plurality of photosensitive drums are driven by a common driving means is employed. That is, in the case where during latent image formation on an objective photosensitive drum, a spacing operation of developing rollers from other photosensitive drums is performed, a load fluctuation generates in the driving means by the spacing operation, so that also the objective photosensitive drum is subjected to the influence of the load fluctuation. As a result, a fluctuation in peripheral speed of the objective photosensitive drum generates and disturbs the latent image to be formed in some cases. Then, by disturbance of an image portion of the latent image, a white stripe image (a phenomenon that a developer is not deposited on the image portion where the developer should be deposited and appears as a stripe-shaped portion) generates in some cases. Further, in the case where a constitution in which a potential is adjusted by subjecting also a non-image portion of the latent image to light is employed, a fog stripe image (a phenomenon that the developer is deposited on the non-image portion where the developer should not be deposited and appears as a stripe-shaped contaminant) generates in some cases.

The influence of the load fluctuation on the photosensitive drum as described above does not generate when a constitution including a plurality of driving means associated with the plurality of photosensitive drums is employed. However, there is a need to prepare the plurality of driving means, and therefore the constitution of the image forming apparatus is complicated, and leads to an increase in cost.

SUMMARY OF THE INVENTION

A principal object of the present invention is to provide an image forming apparatus capable of realizing simplification of a constitution and a reduction in cost by commonality of driving means for image bearing members and capable of reducing a contact opportunity between an image bearing member and a developing member while suppressing image defects.

According to an aspect of the present invention, there is provided an image forming apparatus comprising: a plurality of image bearing members; latent image forming means for forming a latent image on each of the image bearing members; a plurality of developing units for developing the latent images on the image bearing members, wherein the developing units are provided correspondingly to the image bearing members, respectively, and include developing members movable toward and away from the image bearing members, respectively, and the latent images are capable of being formed on the image bearing members by contacting the developing members with the image bearing members, respectively; a movable member onto which images obtained by developing the latent images with developers are transferred from the image bearing members; a common driving source for driving the image bearing members; a contact-and-separation unit for moving developing members toward and away from the image bearing members, respectively; and a control unit for outputting a signal for controlling the contact-and-separation unit, wherein the image forming apparatus is capable of forming the images in an operation in a mode in which the latent images are successively formed on the image bearing members and the images are successively transferred from the image bearing members onto the movable member, and wherein after end of the latent image formation on one of the image bearing members on which latent image formation is finally started and before end of transfer of an associated image from the one image bearing member, the control unit outputs a spacing signal for spacing associated developing members from the other image bearing members, during the image formation in the operation in the mode.

According to another aspect of the present invention, there is provided an image forming apparatus comprising: a plurality of image bearing members; latent image forming means for forming a latent image on each of the image bearing members; a plurality of developing units for developing the latent images on the image bearing members, wherein the developing units are provided correspondingly to the image bearing members, respectively, and include developing members movable toward and away from the image bearing members, respectively, and the latent images are capable of being formed on the image bearing members by contacting the developing members with the image bearing members, respectively; a movable member onto which images obtained by developing the latent images with developers are transferred from the image bearing members; a common driving source for driving the image bearing members; and a contact-and-separation unit for moving developing members toward and away from the image bearing members, respectively, wherein the image forming apparatus is capable of forming the images in an operation in a mode in which the latent images are successively formed on the image bearing members and the images are successively transferred from the image bearing members onto the movable member, and wherein after end of the latent image formation on one of the image bearing members on which latent image formation is finally started and before end of transfer of an associated image from the one image bearing member, associated developing members are spaced from the other image bearing members during the image formation in the operation in the mode.

Further features of the present invention will become apparent from the following description of exemplary embodiments with reference to the attached drawings.

DESCRIPTION OF THE EMBODIMENTS

An image forming apparatus according to the present invention will be described in detail with reference to the drawings.

Embodiment 1

1. Structure of Image Forming Apparatus

Figure 1:
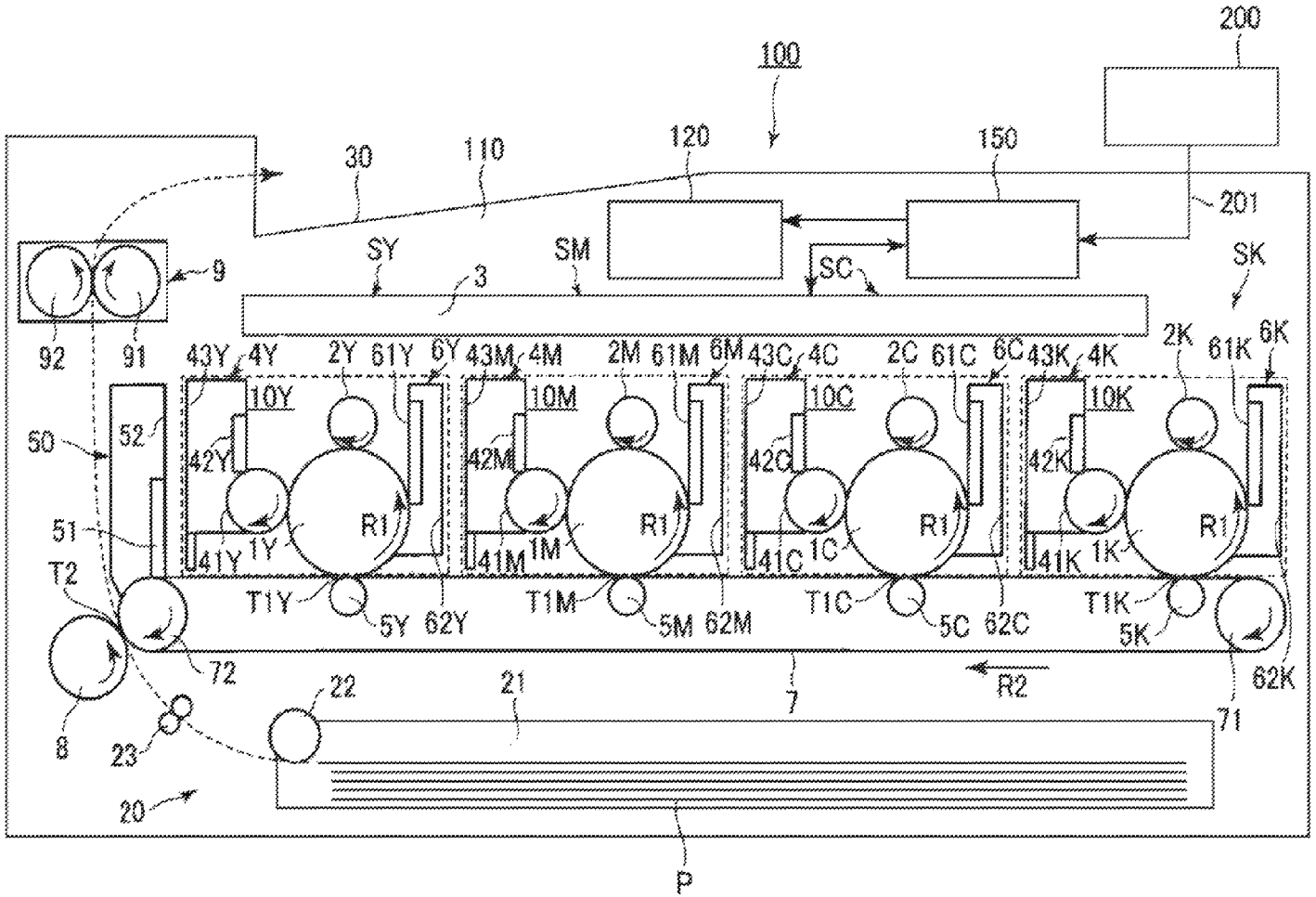
FIG. 1 is a schematic sectional view of an image forming apparatus.

FIG. 1 is a schematic sectional view of an image forming apparatus 100 according to an embodiment of the present invention. In this embodiment, the image forming apparatus 100 is a tandem type color laser printer employing an intermediary transfer type in which first to fourth image forming portions (stations) SY, SM, SC, SK are provided. Image formation at the image forming portions SY, SM, SC, SK is effected using an electrophotographic process. At the image forming portions SY, SM, SC, SK, images of colors of yellow (Y), magenta (M), cyan (C), black (K) are formed, respectively.

Incidentally, with respect to elements which are provided at the image forming portions SY, SM, SC, SK and which have the same functions and structures, in the case where the elements are not required to be particularly distinguished, suffixes Y, M, C, K of reference numerals or symbols showing the elements for any of the image forming portions are omitted, and the elements will be collectively described.

In an apparatus main assembly 110 of the image forming apparatus 100, a controller 150 as a control means for controlling an operation of the image forming apparatus 100 is provided. To the controller 150, image data (electrical image information) is inputted from a printer controller (external host device) 200 connected with the controller 150 via an interface 201. The image forming apparatus 100 forms an image corresponding to the image data inputted into the controller 150 on a recording material P such as a recording sheet, and outputs an image-formed product. The controller 150 performs transfer of various electrical information signals between itself and the printer controller 200. The controller 150 also effects processing of electrical information signals inputted from various process devices, processing of instruction signals sent to the various process devices, predetermined initial sequence control and predetermined image forming sequence control. The printer controller 200 is a host computer, a network, an image reader, a facsimile machine or the like.

The image forming apparatus 100 includes a photosensitive drum 1 which is a drum-shaped (cylindrical) electrophotographic photosensitive member as an image bearing member. At a periphery of the photosensitive drum 1, the following devices are provided. First, a charging roller 2 which is a roller type charging member as a charging means is disposed. Further, a developing device 4 as a developing means is disposed. Further, a drum cleaner 6 as a cleaning means is disposed.

The photosensitive drum 1 is subjected to drive input at an end portion thereof with respect to a longitudinal direction (rotational axis direction) from a drum driving motor (driving source) 120 as a photosensitive member driving means. The photosensitive drum 1 is rotationally driven in an arrow R1 direction in FIG. 1 at a peripheral speed (surface moving speed) of 120 mm/sec.

The developing device 4 uses a non-magnetic one-component developer (toner) as a developer. In this embodiment, the toner is negatively chargeable. The developing device 4 includes a developing roller 41 as a developing member (developer carrying member) for carrying and feeding the toner, a developing blade 42 for uniformizing a toner layer on the developing roller 41, and a developing container 43. In the developing containers 43Y, 43M, 43C, 43K of the developing devices 4Y, 4M, 4C, 4K, the toners of the colors of yellow (Y), magenta (M), cyan (C), black (K) are accommodated, respectively. The developing device 4 is an example of a developing means, including the developing member capable of moving toward and away from the image bearing member, for developing a latent image on the image bearing member in contact with the image bearing member. In this embodiment, the developing rollers 41Y, 41M, 41C, 41K of the developing devices 4Y, 4M, 4C, 4K are independently rotationally driven by an unshown developing (roller) driving motor as a developing (roller) driving means.

In this embodiment, at each of the image forming portions S, the photosensitive drum 1, and as process means actable on the photosensitive drum 1, the charging roller 2, the developing device 4 and the drum cleaner 6 integrally constitute a process cartridge 10 detachably mountable to the apparatus main assembly 110. In this embodiment, the process cartridges 10Y, 10M, 10C, 10K are juxtaposed in a lateral direction (substantially in a horizontal direction) with certain intervals in the apparatus main assembly 110.

The image forming apparatus 100 further includes an exposure device (laser exposure unit), as a latent image forming means (exposure means) for forming a latent image on the photosensitive drum 1 at each of the image forming portions S, for exposing each of the photosensitive drums 1 to light.

The image forming apparatus 100 further includes an intermediary transfer belt 7, as an intermediary transfer member, which is provided opposed to the photosensitive drums 1 and which is formed with an endless belt. The intermediary transfer belt 7 is an example of a movable member onto which images obtained by developing latent images with developers are transferred from the plurality of image bearing members. The intermediary transfer belt 7 is formed in an endless shape using a resin film of about $10^{11}$-$10^{16}$ Ω·cm in electric resistance (volume resistivity) and 100-200 μm in thickness. As a material for the resin film, it is possible to use PVdf (polyvinylidene difluoride), nylon, PET (polyethylene terephthalate), PC (polycarbonate) or the like. The intermediary transfer belt 7 is stretched by two stretching rollers, as a plurality of supporting members, consisting of a driving roller 71 and a secondary transfer opposite roller 72. The driving roller 71 is rotationally driven by an unshown belt driving motor as an intermediary transfer member driving means, whereby the intermediary transfer belt 7 is rotationally driven (circulated) in an arrow R2 direction in FIG. 1 at the substantially same peripheral speed as the peripheral speed of the photosensitive drum 1.

In an inner peripheral surface side of the intermediary transfer belt 7, at positions opposing the photosensitive drums 1 through the intermediary transfer belt 7, primary transfer rollers 5 which are roller-shaped primary transfer members as primary transfer means are provided. The primary transfer rollers 5 are constituted in a roller shape in which an electroconductive layer is provided on a shaft, and are disposed in substantially parallel to the photosensitive drums 1. The primary transfer 5 contacts the intermediary transfer belt 7 toward the photosensitive drum 1 at a predetermined pressure (urging force) and forms a primary transfer portion (primary transfer position, primary transfer nip) T1 where the intermediary transfer belt 7 and the photosensitive drum 1 contact each other. On another peripheral surface side, at a position opposing the secondary transfer opposite roller 72 through the intermediary transfer belt 7, a secondary transfer roller 8 which is a roller-shaped secondary transfer member as a secondary transfer means is provided. The secondary transfer roller 8 contacts the intermediary transfer belt 7 toward the secondary transfer opposite roller 72 at a predetermined pressure and forms a secondary transfer portion (secondary transfer position, secondary transfer nip) T2. On the outer peripheral surface side, at a position downstream of the secondary transfer portion T2 and upstream of an upstreammost primary transfer portion T1Y with respect to a movement direction of the intermediary transfer belt 7, a belt cleaner 50 as an intermediary transfer member cleaning means is provided.

The image forming apparatus 100 further includes a fixing unit 9, a feeding unit 20 and the like. The fixing unit 9 includes a fixing roller 91 heated by a fixing heater and a pressing roller 92 pressed against the fixing roller 91 at a predetermined pressure. The feeding unit 20 includes a cassette for accommodating a recording material (transfer material, recording medium) P, a pick-up roller 22 for sending the recording material P one by one from the cassette 21, a feeding roller pair 23 for feeding the recording material P sent from the pick-up roller 22, and the like member.

In this embodiment, each of the image forming portions S is constituted by the photosensitive drum 1, the charging roller 2, the exposure device 3 for exposing the photosensitive drums 1 to light, the developing device 4, the primary transfer roller 5, and the like member.

2. Image Forming Process

When the controller 150 receives a print signal (image formation start signal), the image forming apparatus 100 starts an operation of a rotationally driving portion such as the photosensitive drum 1 and the intermediary transfer belt 7, and thus starts an image forming operation. After rotation of the photosensitive drum 1 is started, a predetermined charging voltage (charging bias) is applied from an unshown charging voltage source (high voltage source) to the charging roller 2, so that the surface of the photosensitive drum 1 is electrically charged uniformly to a predetermined potential at a charging position.

The charged surface of the photosensitive drum 1 reaches an exposure position and thereafter a laser element of the exposure device 3 is turned on depending on image information, so that the latent image (electrostatic latent image, electrostatic image) is formed on the photosensitive drum 1. To the exposure device 3, time-series electrical digital pixel signals which are inputted from the printer controller 200 into the controller 150 via the interface 201 and which are then subjected to image processing in the controller 150 are inputted. The exposure device 3 includes a laser output portion for outputting laser light modulated correspondingly to the time-series electrical digital pixel signals of the image information subjected to the image processing, a rotatable polygon mirror, an fθ lens, a reflection mirror and the like. The exposure device 3 subjects the surface of the photosensitive drum 1 to main scanning exposure to light with respect to a direction substantially perpendicular to a surface movement direction of the photosensitive drum 1. By a combination of this main scanning exposure with sub-scanning by rotation of the photosensitive drum 1, the latent image corresponding to the image information is formed.

The latent image formed on the photosensitive drum 1 is developed (visualized) into a toner image (developer image) with the toner on the developing roller 41, of the developing device 4, rotating in contact with the photosensitive drum 1. At this time, to the developing roller 41, a predetermined developing voltage (developing bias) is applied from an unshown developing voltage source (high voltage source). In this embodiment, the developing device 4 forms the toner image by reversal development. That is, on an exposed portion of the photosensitive drum 1 where an absolute value of the potential is lowered by the exposure after the photosensitive drum 1 is uniformly charged, the toner charged to the same polarity (negative in this embodiment) as a charge polarity of the photosensitive drum 1 is deposited.

The toner image formed on the photosensitive drum 1 is transferred (primary-transferred) onto the intermediary transfer belt 7 at the primary transfer portion T1 by the action of the primary transfer roller 5. At this time, to the primary transfer roller 5, a primary transfer voltage (primary transfer bias) which is a DC voltage of an opposite polarity (positive in this embodiment) to a charge polarity of the toner during the development is applied from an unshown primary transfer voltage source (high voltage source). As a result, at the primary transfer portion T1, a transfer electric field is formed by a potential difference between the intermediary transfer belt 7 and the photosensitive drum 1, and by this transfer electric field, the toner image is electrostatically transferred from the photosensitive drum 1 onto the intermediary transfer belt 7.

During full-color image formation for example, the above-described steps of the charging, the exposure, the development and the primary transfer are successively performed. As a result, a multiple toner image transferred onto the intermediary transfer belt 7 so as to superposed the toner images of the respective colors.

The toner images formed on the intermediary transfer belt 7 are transferred (secondary-transferred) onto the recording material P at the secondary transfer portion T2 by the action of the secondary transfer roller 8. At this time, to the secondary transfer roller 8, a secondary transfer voltage (secondary transfer bias) which is a DC voltages of the opposite polarity to the normal charge polarity of the toner is applied from an unshown secondary transfer voltage source (high voltage source). The recording material P is fed to the secondary transfer portion T2 at predetermined timing by the feeding unit 20.

The recording material P on which the toner images are transferred passes through between the fixing roller 91 warmed to a predetermined temperature and the pressing roller 92 pressed against the fixing roller 91 at a predetermined pressure in the fixing unit 9. As a result, the toner is melted and fixed on the recording material P, and thereafter the recording material P is fed to a discharge tray 30 at an outer portion of the apparatus main assembly 110.

In parallel to the above step, a step of removing transfer residual toners on the photosensitive drum 1 and the intermediary transfer belt 7 is performed. That is, the toner (primary transfer residual toner) remaining on the photosensitive drum 1 without being transferred onto the intermediary transfer belt 7 at the primary transfer portion T1 is removed and collected from the photosensitive drum 1 by the drum cleaner 6. The drum cleaner 6 scrapes off the primary transfer residual toner from the rotating photosensitive drum 1 and collects the primary transfer residual toner in a cleaner container 62 by a blade member 61. Further, the toner (secondary transfer residual toner) remaining on the intermediary transfer belt 7 without being transferred onto the recording material P at the secondary transfer portion T2 is removed and collected by the belt cleaner 50. The belt cleaner 50 scraped off the secondary transfer residual toner from the rotating intermediary transfer belt 7 and collects the secondary transfer residual toner in a cleaner container 52 by a blade member 51.

In this embodiment, the drive (driving force) is inputted from a common drum driving motor 120 into all of the photosensitive drums 1Y, 1M, 1C, 1K of the first to fourth image forming portions SY, SM, SC, SK via an unshown drive transmitting means, so that the photosensitive drums 1Y, 1M, 1C, 1K are rotationally driven. That is, in this embodiment, the single (common) drum driving motor 120 is driven and stopped by receiving the signals from the controller 150, and depending on the drive and the stop of the single drum driving motor 120, all of the photosensitive drums 1Y, 1M, 1C, 1K are driven and stopped. As a result, compared with a constitution in which the plurality of photosensitive drums are rotationally driven by separate driving means, it becomes possible to simplify the structure of the image forming apparatus 100 and reduce the cost.

3. Contact-and-Separation Means

Figure 2A:
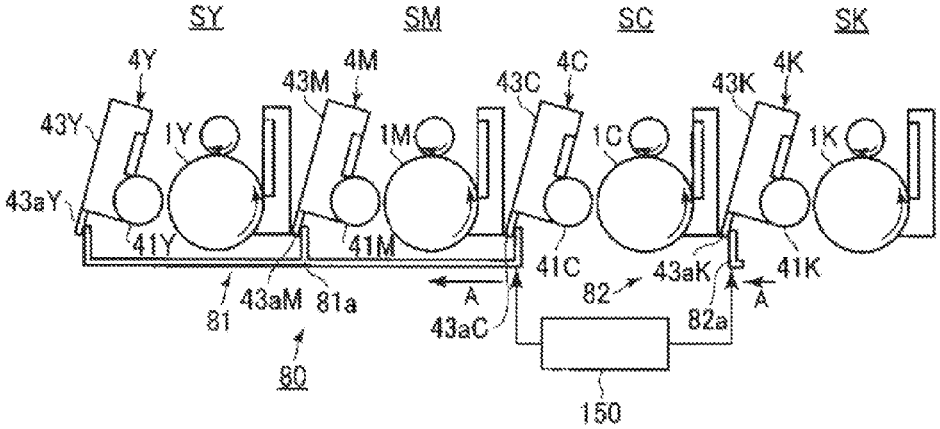
In FIG. 2, (a) and (b) are schematic views for illustrating an operation of a contact-and-separation mechanism.
Figure 2B:
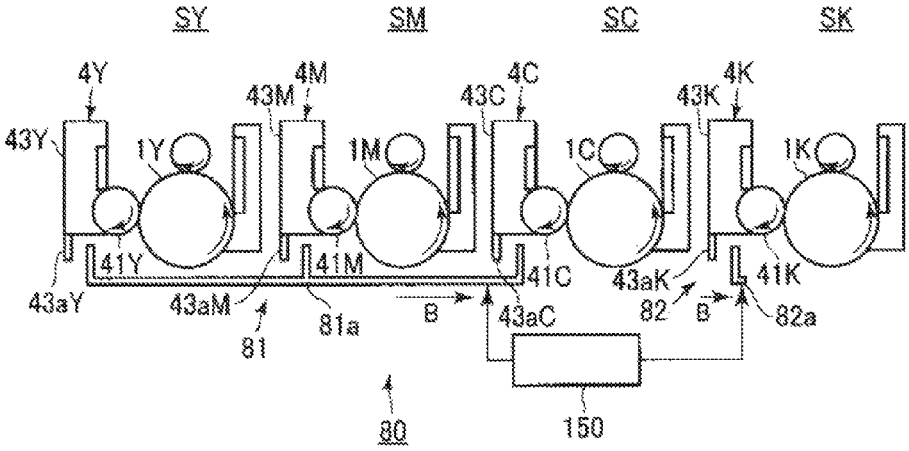

In FIG. 2, (a) and (b) are schematic views for illustrating a contact-and-separation means 80 for moving the developing roller 41 of the developing device 4 toward and away from the photosensitive drum 1 in this embodiment. In this embodiment, the contact-and-separation means 80 includes a first contact-and-separation mechanism 81 for moving the developing rollers 41Y, 41M, 41C toward and away from the corresponding photosensitive drums 1Y, 1M, 1C of the first to third image forming portions SY, SM, SC, respectively. Further, in this embodiment, the contact-and-separation means 80 includes a second contact-and-separation mechanism 82 for moving the developing roller 41K toward and away from the corresponding photosensitive drum 1K of the fourth image forming portion SK. In this embodiment, the first contact-and-separation mechanism 81 places the developing rollers 41Y, 41M, 41C corresponding to the photosensitive drums 1Y, 1M, 1C of the first to third image forming portions SY, SM, SC simultaneously in a contact state or a spaced state. Here, the simultaneous formation of the contact state and the spaced state includes the case where timing is deviated within an error range allowed for obtaining an effect specifically described later, and may only be required to be regarded as being substantially simultaneous. Typically, the simultaneous formation may only be required that a part of a period from a start of a contacting operation or a spacing operation to an end of the operation overlaps with the other operation. In this embodiment, the second contact-and-separation mechanism 82 operates independently of the first contact-and-separation mechanism 81, and places the developing roller 41K associated with the photosensitive drum 1K of the fourth image forming portion SK in the contact state or the spaced state.

Incidentally, herein, the image forming portions SY, SM, SC, SK or elements for the image forming portions SY, SM, SC, SK are distinguished by adding prefixes "Y", "M", "C", "K" in some cases. A state in which the developing roller 41 is contacted to or spaced (separated) from the associated photosensitive drum 1 by the first or second contact-and-separation mechanism 81 or 82 is also referred to simply as the "contact state" or the "spaced state" of the first or second contact-and-separation mechanism 81 or 82 or the developing roller 41.

In FIG. 2, (a) shows the spaced state of the first and second contact-and-separation mechanisms 81 and 82. The first and second contact-and-separation mechanisms 81 and 82 more moving members 81*a* and 82*a*, respectively, in an arrow A direction in the figure by an operation of an unshown contact-and-separation (mechanism) driving motor as a contact-and-separation driving means upon receipt of a signal from the controller 150. As a result, the first and second contact-and-separation mechanisms 81 and 82 push receiving portions 43*a* formed as a part of the developing containers 43 by the moving members 81*a* and 82*a*, so that the developing rollers 41 are placed in the spaced state. In this embodiment, as described above, the developing rollers 41 of the developing devices 4Y, 4M, 4C, 4K are rotationally driven by independent developing driving motors. In this embodiment, when the developing rollers are placed in the spaced state, the corresponding developing driving motors are controlled by the controller 150, so that the rotational drive of the developing rollers 41 is stopped.

In FIG. 2, (b) shows the contact state of the first and second contact-and-separation mechanisms 81 and 82. The first and second contact-and-separation mechanisms 81 and 82 more the moving members 81*a* and 82*a*, respectively, in an arrow B direction in the figure by the operation of the unshown contact-and-separation (mechanism) driving motor upon receipt of a signal from the controller 150. As a result, the first and second contact-and-separation mechanisms 81 and 82 eliminate the urging of the receiving portions 43*a* of the developing containers 43, so that the developing rollers 41 are placed in the contact state. In this embodiment, the developing containers 43 are swingably held, and the developing rollers 41 are urged in a contact direction with the photosensitive drums 1 by springs as an urging means. In this embodiment, when the developing rollers are placed in the contact state, the corresponding developing driving motors are controlled by the controller 150, so that the rotational drive of the developing rollers 41 is started.

The controller 150 controls the first and second contact-and-separation mechanisms 81 and 82 so as to be placed in the contact state during the full-color image formation. During black (single color) image formation as monochromatic image formation, the controller 150 controls the first contact-and-separation mechanism 81 so as to be placed in the spaced state and controls the second contact-and-separation mechanism 82 so as to be placed in the contact state.

As described above, in this embodiment, by the two contact-and-separation mechanisms which operate independently of each other, in the operation in the full-color mode in which the images are formed at the YMCK image forming portions SY, SM, SC, SK and in the operation in the monochromatic mode in which the image is formed at only the K image forming portion SK, the contact state and the spaced state are switched from each other. As a result, compared with, e.g., the case where contact-and-separation mechanisms which independently operate for the YMCK image forming portions SY, SM, SC, SK, the number of the contact-and-separation mechanisms can be reduced, and it is possible to realize simplification of the structure of the image forming apparatus 100 and a reduction in cost Further, during the monochromatic image formation, it is possible to place the photosensitive drums 1 and the developing rollers 41 which are not needed for the image formation in the spaced state. As described specifically later, at the time of end of the full-color image formation, the photosensitive drums 1 and the developing rollers 41 of the YMC image forming portions SY, SM, SC can be placed in the spaced state as soon as possible. As a result, the contact opportunity between the photosensitive drums 1 and the developing rollers 41 of the YMC image forming portions SY, SM, SC is reduced, so that it becomes possible to suppress wearing of the photosensitive drum 1 and the developing roller 41 or the toner disposed therebetween. Here, the time of the end of the full-color image formation includes that when a single color image is formed, the time of the end of final full-color image formation when a plurality of full-color images are formed, the time of the end of final full-color image formation before extension of a sheet interval in the case where the sheet interval is extended for executing an adjusting or the like when the plurality of full-color images are formed, and that immediately before a change to monochromatic image formation when the image formation is changed from the full-color image formation to the monochromatic image formation. That is, the time of the end of the full-color image formation includes any case where the developing rollers 41 are spaced from the photosensitive drums 1 of the YMC image forming portions SY, SM, SC when one of the full-color image formation operations. The sheet interval refers to a period corresponding to an interval between a recording material P and a subsequent recording material P when the images are continuously formed on the plurality of recording materials P.

4. Spacing Timing

Figure 3:
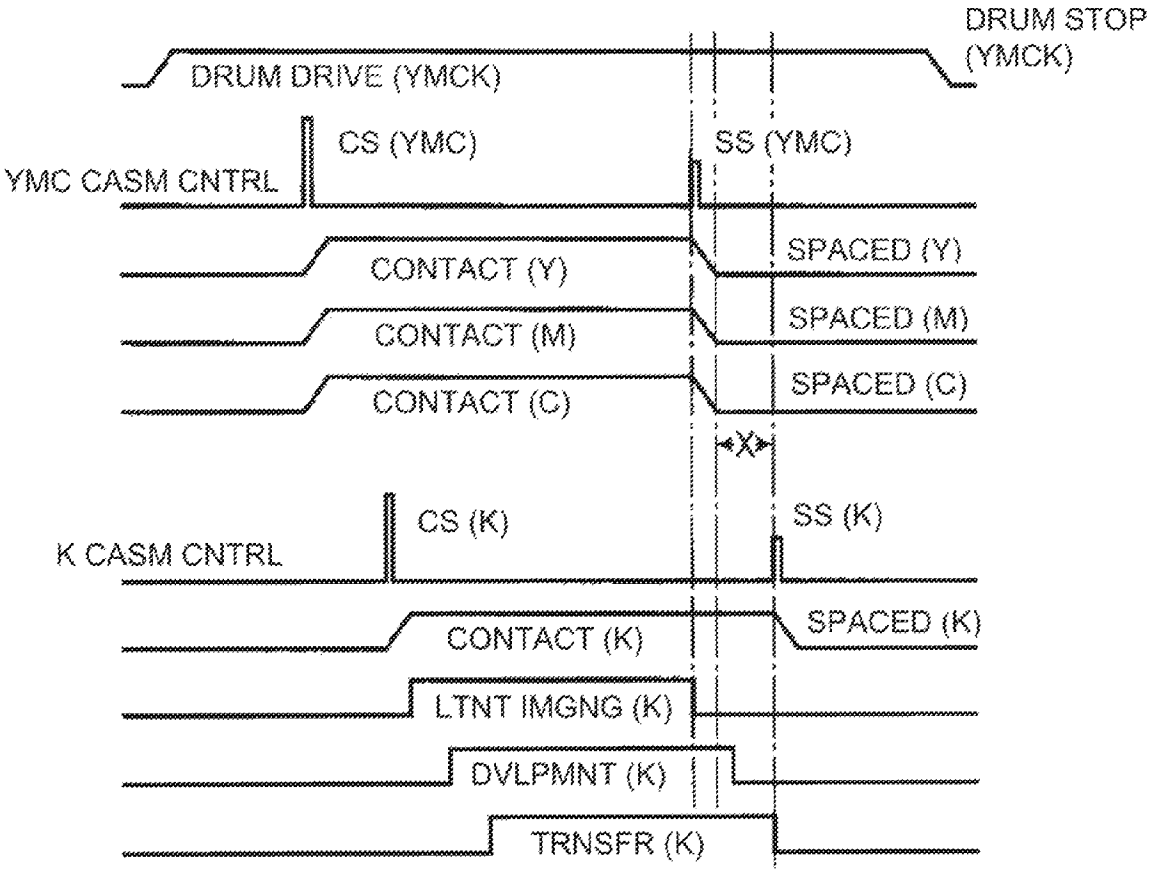
FIG. 3 is a timing chart of an image forming operation in Embodiment 1.

FIG. 3 is a timing chart schematically showing operation timing of each of portions during the full-color image formation. FIG. 3 shows an example in the case where a single full-color image is formed.

First, all of the photosensitive drums 1Y, 1M, 1C, 1K are driven by a single drum driving motor 120. Thereafter, the controller 150 sends a signal (contact signal) for contacting the YMC developing rollers 41Y, 41M, 41C with the YMC photosensitive drums 1Y, 1M, 1C to the YMC contact-and-separation mechanism 81. As a result, the YMC developing rollers 41Y, 41M, 41C are contacted to the photosensitive drums 1Y, 1M, 1C. Thereafter, on the YMC photosensitive drums 1Y, 1M, 1C, the latent image formation, the development and the transfer are successively effected.

In parallel to the execution of the latent image formation, the development and the transfer on the YMC photosensitive drums 1Y, 1M, 1C, the controller 150 sends the contact signal to the K contact-and-separation mechanism 82 at the following timing. That is, the controller 150 sends the contact signal to the K contact-and-separation mechanism 82 before start of the latent image formation at the K photosensitive drum K, of the YMCK photosensitive drums 1Y, 1M, 1C, 1K, on which the latent image formation is finally started during the full-color image formation. As a result, the K developing roller 41K contacts the K photosensitive drum 1K. Thereafter, at the K photosensitive drum 1K, the latent image formation, the development and the transfer are executed. Accordingly, at the K photosensitive drum 1K, the latent image formation is finally ended, and each of the development and the transfer is finally started and finally ended.

Here, in this embodiment, during execution of the latent image formation at any one of the YMC photosensitive drums 1Y, 1M, 1C, the K developing roller 41K contacts the K photosensitive drum 1K. However, when the three developing rollers 41Y, 41M, 41C are in the contact state, the single developing roller 41K is placed in the contact state, and therefore a load fluctuation of the drum driving motor 120 is sufficiently small, so that the latent image formation at any one of the YMC photosensitive drums 1Y, 1M, 1C is not disturbed. For that reason, timing of sending the contact signal to the K contact-and-separation mechanism 82 can be timed to the latent image formation at the K photosensitive drum 1K and can be made later than timing of sending the contact signal to the YMC contact-and-separation mechanism 81. As a result, it is possible to suppress the wearing of the K photosensitive drum 1K and the K developing roller 41K or the toners disposed therebetween.

Substantially, the controller 150 sends a signal (spacing signal) for spacing the YMC developing rollers 41Y, 41M, 41C from the YMC photosensitive drums 1Y, 1M, 1C to the YMC contact-and-separation mechanism 81. At this time, in this embodiment, the controller 150 sends the spacing signal to the YMC contact-and-separation mechanism 81 in a period after the start of the latent image formation at the K photosensitive drum 1K and before the end of the transfer at the K photosensitive drum 1K. As a result, the YMC developing rollers 41Y, 41M, 41C are spaced from the YMC photosensitive drums 1Y, 1M, 1C.

In this way, in this embodiment, the spacing signal is sent to the YMC contact-and-separation mechanism 81 before the end of the transfer at the K photosensitive drum 1K. As a result, at the time of the end of the full-color image formation, the YMC photosensitive drums 1Y, 1M, 1C and the YMC developing rollers 41Y, 41M, 41C can be placed in the spaced state earlier than timing when the K developing roller 41K is spaced from the K photosensitive drum 1K. As a result, it is possible to suppress the wearing of the YMC photosensitive drums 1Y, 1M, 1C and the developing rollers 41Y, 41M, 41C or the toners disposed therebetween.

Here, assuming that the spacing signal is sent to the YMC contact-and-separation mechanism 81 during the latent image formation at the K photosensitive drum 1K, when the four developing rollers 41Y, 41M, 41C, 41K are in the contact state, the three developing rollers 41Y, 41M, 41C are placed on the spaced state simultaneously. As a result, a large load fluctuation generates in the drum driving motor 120 and disturbs the latent image formation at the K photosensitive drum 1K, so that the above-mentioned white stripe image or fog stripe image generates in some cases. Therefore, in this embodiment, after the end of the latent image formation at the K photosensitive drum 1K, the spacing signal is sent to the YMC contact-and-separation mechanism 81.

Thereafter, the controller 150 sends the spacing signal to the K contact-and-separation mechanism 82 after the end of the transfer at the K photosensitive drum 1K. As a result, the K developing roller 41K is spaced from the K photosensitive drum 1K. Further, finally, the drive of the drum driving motor 120 is stopped, so that the drive of all of the photosensitive drums 1Y, 1M, 1C, 1K is stopped.

As described above, FIG. 3 shows an example in the case where the single color image is formed. Also in the case where the plurality of full-color images are formed, during the spacing operation of the YMC developing rollers 41Y, 41M, 41C from the YMC photosensitive drums 1Y, 1M, 1C, the spacing operation may only be required to be performed at the above-mentioned timing.

As described above, in the case where only a part of the plurality of photosensitive drums is subjected to the image formation, it is preferable that the developing roller is spaced from the photosensitive drum which is not subjected to the image formation in order to suppress the wearing of the photosensitive drum and the developing roller or the toner disposed therebetween. This spacing operation is performed, e.g., at the time of the end of the full-color image formation as described above. At the YMC image forming portions where the full-color image formation is ended, the developing rollers may desirably be spaced from the photosensitive drums as early as possible. This is because the progression of the above-described deterioration of the photosensitive drums, the developing rollers or the toner can be suppressed with earlier possible timing of spacing the developing rollers from the photosensitive drums. Therefore, in this embodiment, during the full-color image formation, specifically before the end of the transfer of the toner image at the K image forming portion where the image formation is finally effected, the developing rollers are spaced from the photosensitive drums at the YMC image forming portions. More specifically, in this embodiment, an instruction therefor is provided. However, when the developing rollers are spaced from the photosensitive drums, a fluctuation in peripheral speed of the photosensitive drum generates due to the load fluctuation of the drum driving motor, and vibration generates in some cases. For that reason, when the developing rollers are spaced from the photosensitive drums so early at the YMC image forming portions, there is a possibility that the image formation at the K image forming portion is influenced. Therefore, in this embodiment, the controller waits for the latent image formation on the photosensitive drum at the K image forming portion and then causes the developing rollers from the photosensitive drums at the YMC image forming portions. More specifically, in this embodiment, the controller provides an instruction therefor. This is because if the timing is after the latent image is formed, even when the above-mentioned peripheral speed fluctuation and vibration generate, it is possible to suppress the influence on the image. That is, even in the case where the peripheral speed of the K photosensitive drum 1K fluctuates, the K developing roller 41K and the intermediary transfer belt 7 contact the K photosensitive drum 1K at predetermined pressure, and therefore the peripheral speeds of the K developing roller 41K and the intermediary transfer belt 7 fluctuate in synchronism with the peripheral speed fluctuation of the K photosensitive drum 1K to some extent. For this reason, during the development and during the transfer, the peripheral speed fluctuation of the K photosensitive drum 1K does not readily have the influence on the image. In this manner, in this embodiment, at the time of the end of the full-color image formation, operations are performed in the following order.

(1) The latent image formation on the K photosensitive drum 1K in the full-color image formation is ended.

(2) The YMC developing rollers are spaced from the YMC photosensitive drums. During this operation, the latent image is developed on the K photosensitive drum.

(3) The toner image formed on the K photosensitive drum is transferred onto the intermediary transfer belt.

As described above, in this embodiment, the image forming apparatus 100 includes the common driving means 120 for driving the plurality of image bearing members 1 and the contact-and-separation means for moving the developing members 41 toward and away from the associated image bearing members 1, respectively. The image forming apparatus 100 further includes the control means 150 for outputting the signals for controlling the contact-and-separation means 80. The image forming apparatus 100 is capable of forming the images in the operation in the mode (full-color mode) in which the images formed with the developers are successively transferred from the plurality of image bearing members 1 onto the movable member 7. Here, of the plurality of image bearing members 1, the image bearing member 1 on which the latent image formation started when the image formation is effected in the operation in the mode is the final image bearing member 1K. Of the plurality of image bearing members 1, the image bearing members 1 other than the final image bearing member 1K are other image bearing members 1Y, 1M, 1C. At this time, the controller 150 outputs the following signal when the image formation is effected in the operation in the mode and the state of the developing members is changed from the contact state of the developing members with the associated image bearing members to the spaced state of the developing members from the above-mentioned other image bearing members. That is, the controller 150 outputs the spacing signal for spacing the developing members from the above-mentioned other image bearing members after the end of the latent image formation on the final image bearing member 1K are before the end of the transfer from the final image bearing member 1K. Particularly, in this embodiment, the contact-and-separation means 80 includes the first contact-and-separation mechanism 81 for moving the developing member 41 toward and away from the final image bearing member 1K. Further, in this embodiment, the contact-and-separation means 80 includes the second contact-and-separation mechanism 82 for moving the developing members 41Y, 41M, 41C toward and away from the above-mentioned other image bearing members 1Y, 1M, 1C.

5. Effect

An effect of this embodiment will be described in comparison with the case where the image forming apparatus is operated at timing shown in FIG. 4 as Comparison Example. In Comparison Example shown in FIG. 4, the controller sends the spacing signal to the YMC contact-and-separation mechanism 81 and the K contact-and-separation mechanism 82 simultaneously after the end of the transfer at the K photosensitive drum 1K.

Figure 4:
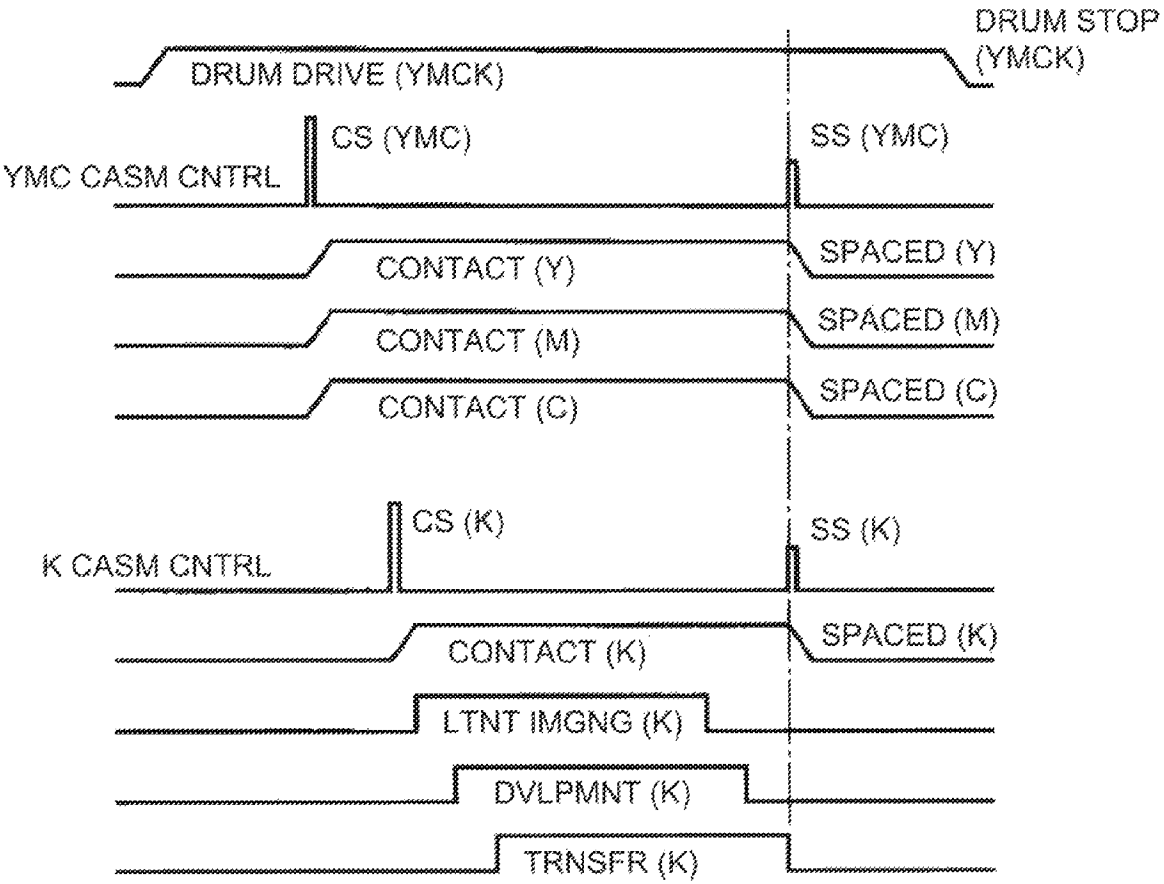
FIG. 4 is a timing chart of an image forming operation in Comparison Example.

As in Comparison Example shown in FIG. 4, in the case where the spacing signal is sent to the YMC contact-and-separation mechanism 81 after the end of the transfer at the K photosensitive drum 1K, timing of sending the spacing signal to the YMC contact-and-separation mechanism 81 and timing of sending the spacing signal to the K contact-and-separation mechanism 82 are the same. As a result, a contact time between the YMC photosensitive drums 1Y, 1M, 1C and the YMC developing rollers 41Y, 41M, 41C becomes long more than necessary.

On the other hand, in this embodiment shown in FIG. 3, compared with Comparison Example shown in FIG. 4, an effect of shortening the contact time between the YMC photosensitive drums 1Y, 1M, 1C and the YMC developing rollers 41Y, 41M, 41C by a period X shown in FIG. 3 is achieved. For example, in the case where one sheet printing of an A-sized sheet is executed, in this embodiment, compared with Comparison Example, the contact time between the photosensitive drums 1 and the developing rollers 41 at the YMC image forming portions SY, SM, SC was shortened by about 20%. Further, in the case where the above condition is repeated and printing of 5000 sheets in total is made, in this embodiment, compared with Comparison Example, an effect of suppressing the wearing corresponding to 1000 sheets can be obtained at each of the YMC image forming portions SY, SM, SC.

Further, a constitution in which the K developing roller 41K and the intermediary transfer belt 7 are driven by the drum driving motor 120 may also be employed. In this case, even in the case where the developing rollers are spaced from the photosensitive drums at the YMC image forming portions, even when the load fluctuation of the drum driving motor 120 has the influence on the peripheral speed of the K photosensitive drum 1K, the load fluctuation has a similar influence on also the peripheral speeds of the K developing roller 41K and the intermediary transfer belt 7. For this reason, it is possible to suppress further influence of the peripheral speed fluctuation of the K photosensitive drum 1K on the image.

As described above, according to this embodiment, it is possible to suppress the generation of the white stripe image and the fog stripe image at the K image forming portion SK generating due to the load fluctuation of the drum driving motor 120 by the spacing operation for spacing the developing rollers 41 from the photosensitive drums 1 at the YMC image forming portions SY, SM, SC. In addition, it is possible to suppress the deterioration due to the wearing of the YMC photosensitive drums 1Y, 1M, 1C, the YMC developing rollers 41Y, 41M, 41C and the toners disposed therebetween. As a result, high-quality image output can be performed for a long term. That is, according to this embodiment, not only simplification and cost reduction of the constitution can be realized by commonality of the drum driving motor but also a reduction in contact opportunity between the photosensitive drum and the developing roller can be made while suppressing the image defects.

Embodiment 2

Another embodiment of the present invention will be described. Basic constitution and operation of an image forming apparatus in this embodiment are the same as those in Embodiment 1. Accordingly, elements having the same or corresponding functions or constitutions as those for the image forming apparatus in Embodiment 1 are represented by the same reference numerals or symbols, and will be omitted from detailed description.

In Embodiment 1, the constitution in which all of the photosensitive drums 1Y, 1M, 1C, 1K were rotationally driven by the single drum driving motor 120 and the developing rollers 41Y, 41M, 41C, 41K were rotationally driven by the separate developing (roller) driving motors was employed.

On the other hand, in this embodiment, a constitution in which all of the photosensitive drums 1Y, 1M, 10, 1K and all of the developing rollers 41Y, 41M, 41C, 41K are rotationally driven by the single driving motor 120 is employed.

Figure 5A:
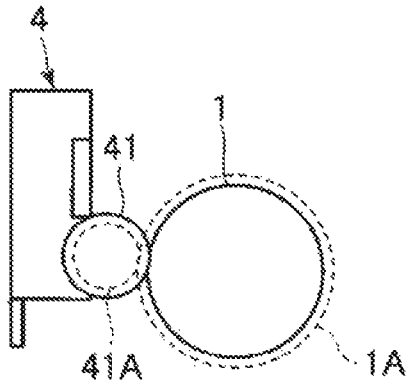
FIG. 5, (a) and (b) are schematic views for illustrating an operation of a drive transmitting portion of a developing roller.
Figure 5B:
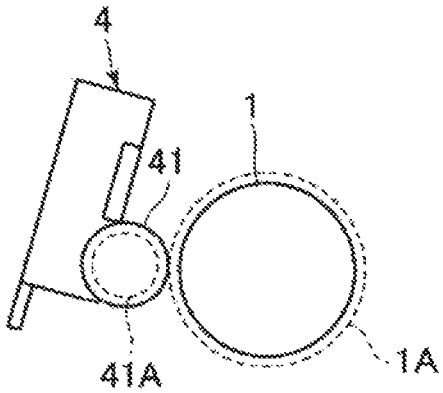

Further, in this embodiment, a constitution in which at the image forming portions S, rotation of developing rollers is stopped by eliminating the drive input from the driving motor 120 into the developing rollers 41 in interrelation with the spacing operation for spacing the developing rollers 41 from the photosensitive drums 1 is employed. In this embodiment, as shown in (a) of FIG. 5, a driving force transmitted from the driving motor 120 to the photosensitive drum 1 is transmitted to the developing roller 41 by engagement between gears 1A, 41A of drive transmitting members provided at longitudinal end portion of the photosensitive drum 1 and the developing roller 41. Then, similarly as in Embodiment 1, when the developing roller 41 is spaced from the photosensitive drum 1 by swing of the developing container 43, as shown in (b) of FIG. 5, the engagement between the gears 1A, 41A is eliminated, so that the drive input into the developing roller 41 is eliminated.

In this way, in this embodiment, the developing members 41Y, 41M, 41C, 41K of the plurality of developing means 4Y, 4M, 4C, 4K are driven by the common driving means 120 for driving the plurality of image bearing members 1Y, 1M, 1C, 1K. Then, after the control means 150 outputs the signal for spacing the developing members 41 from the image bearing members 1, the input of the drive from the common driving means 120 into the developing members 41 is eliminated.

In the constitution in this embodiment, compared with Embodiment 1, it is possible to reduce the number of the driving motors for driving the developing rollers 41, so that simplification and cost reduction of the constitution of the image forming apparatus 100 can be realized. On the other hand, in this embodiment, compared with Embodiment 1, the load fluctuation of the driving motor 120 by the spacing operation for spacing the developing members 41 from the photosensitive drums 1 becomes larger.

Therefore, in this embodiment, similarly as in Embodiment 1, the spacing operation for spacing the developing rollers 41 from the photosensitive drums 1 at the YMC image forming portions SY, SM, SC is performed. As a result, it is possible to suppress the wearing of the YMC photosensitive drums 1Y, 1M, 1C and the YMC developing rollers 41Y, 41M, 41C or the toners therebetween while suppressing the influence of the larger load fluctuation as described above.

Embodiment 3

Another embodiment of the present invention will be described. Basic constitution and operation of an image forming apparatus in this embodiment are the same as those in Embodiments 1 and 2. Accordingly, elements having the same or corresponding functions or constitutions as those for the image forming apparatus in Embodiments 1 and 2 are represented by the same reference numerals or symbols, and will be omitted from detailed description.

In this embodiment, the constitution in which the controller 150 sends the spacing signal to the YMC contact-and-separation mechanism 81 after the end of the latent image formation on the K photosensitive drum 1K and before the end of the transfer from the K photosensitive drum 1K was employed. After receiving the spacing signal, the YMC contact-and-separation mechanism 81 moves in the arrow A direction in (a) of FIG. 2, so that the YMC developing rollers 41Y, 41M, 41C are spaced from the YMC photosensitive drums 1Y, 1M, 1C. For that reason, in the case of the constitution of Embodiment 1, in some cases, a time difference generates to some extent in a period from receipt of the spacing signal by the YMC contact-and-separation mechanism 81 until the spacing operation is completed.

On the other hand, in this embodiment, in view of the above time difference, the controller 150 sends the spacing signal to the YMC contact-and-separation mechanism 81 before the end of the latent image formation on the K photosensitive drum 1K. As a result, in a period after the end of the latent image formation on the K photosensitive drum 1K and before the end of the transfer from the photosensitive drum 1K, the YMC developing rollers 41Y, 41M, 41C are spaced from the YMC photosensitive drums 1Y, 1M, 1C.

Figure 6:
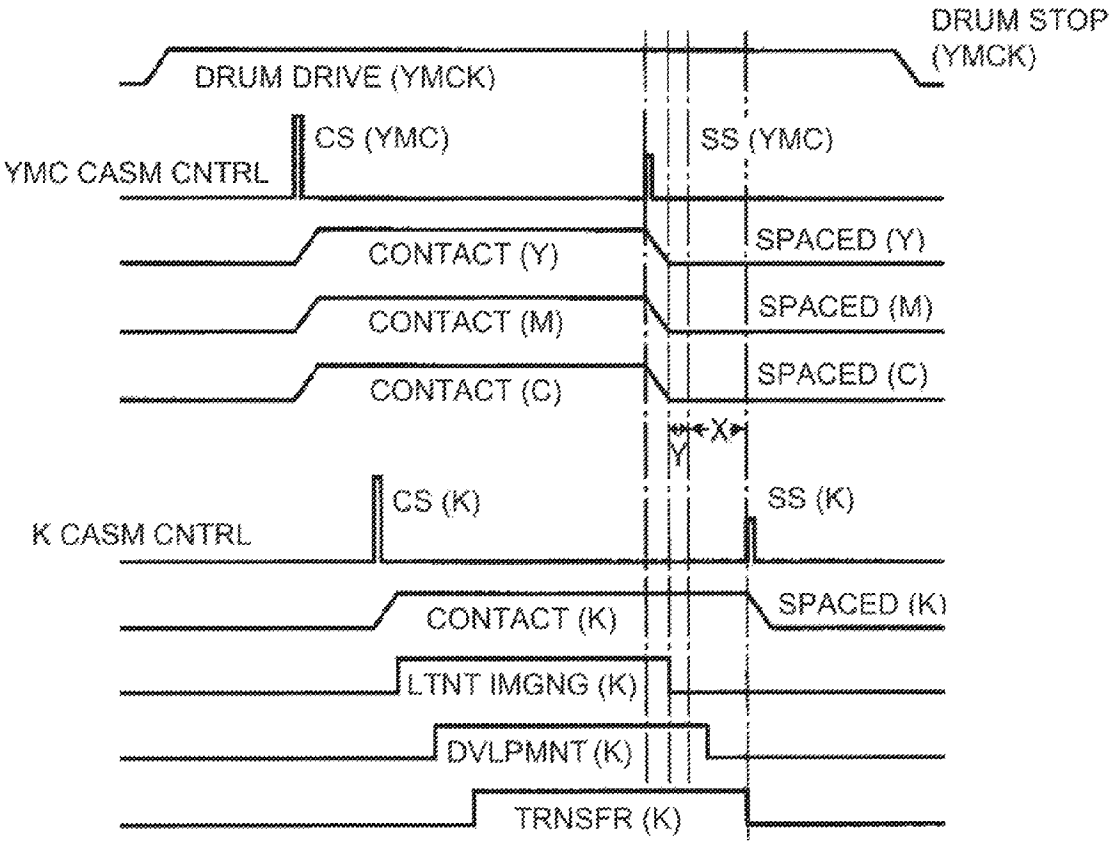
FIG. 6 is a timing chart of an image forming operation in Embodiment 3.

FIG. 6 is a timing chart schematically showing operation timing of portions during the full-color image formation in this embodiment. In this embodiment, compared with Embodiment 1, the contact time between the YMC photosensitive drums 1Y, 1M, 1C and the developing rollers 41Y, 41M, 41C can be shortened by a period Y from receipt of the spacing signal by the YMC contact-and-separation mechanism 81 until the spacing operation is actually completed. In this embodiment, substantially simultaneously with the end of the latent image formation on the K photosensitive drum 1K, the spacing operation for spacing the YMC developing rollers 41Y, 41M, 41C from the YMC photosensitive drums 1Y, 1M, 1C is completed. The operation in accordance with the timing chart of FIG. 6 in this embodiment is the same as the operation in accordance with the timing chart of FIG. 3 in Embodiment 1 except for the above-described point.

In this embodiment, when the developing member state is changed from the contact state of the developing members with the associated image bearing members in the image formation in the operation in the full-color mode to the spaced state of the developing members from the associated image bearing members other than the final image bearing members, the following operation is performed. That is, after the end of the latent image formation on the final image bearing member and before the end of the transfer from the final image bearing member, the developing members 41Y, 41M, 41C are spaced from the associated image bearing members 1Y, 1M, 1C other than the final image bearing member 1K. Incidentally, this embodiment can also be executed in combination with Embodiment 2. In this case, the developing members 41 of the plurality of developing means 4Y, 4M, 4C, 4K are driven by the common driving means 120 for driving the plurality of image bearing members 1. Then, after the developing members 41 are spaced from the image bearing members 1, the input of the drive from the common driving means 120 into the developing members 41 is eliminated.

As described above, according to this embodiment, an effect similar to the effect of Embodiment 1 can be achieved in a higher degree.

Other Embodiments

The present invention was described above based on the specific embodiments, but is not limited to the above-described embodiments.

For example, in the above-described embodiments, the contact-and-separation means is constituted by including the two contact-and-separation mechanisms consisting of the first contact-and-separation mechanism 81 and the second contact-and-separation mechanism 82, but the present invention is not limited thereto. For example, a constitution in which a plurality of contact-and-separation mechanisms for independently moving the developing rollers toward and away from the photosensitive drums 1 of the YMC image forming portions SY, SM, SC may also be employed. The present invention is effective in the case where when the images are successively transferred from a plurality of photosensitive drums onto a transfer-receiving member, such a combination that the influence of the load fluctuation of the driving motor caused by spacing the developing rollers from the photosensitive drums other than the final photosensitive drum where the latent image formation is finally started is exerted on the final photosensitive drum is employed.

In the above-described embodiments, as shown in FIGS. 3 and 6, during the latent image formation at any of YMC image forming portions SY, SM, SC, the developing roller 41K was contacted to the photosensitive drum 1K at the K image forming portion SK. As a result, as described above, it is possible to suppress the wearing of the K photosensitive drum 1K and the K developing roller 41K or the toner disposed between the K photosensitive drum 1K and the K developing roller 41K. However, the present invention is not limited thereto but for example, the K developing roller 41K may also be contacted to the K photosensitive drum 1K simultaneously with the contact of the YMC developing rollers 41Y, 41M, 41C with the YMC photosensitive drums 1Y, 1M, 1C.

Figure 7:
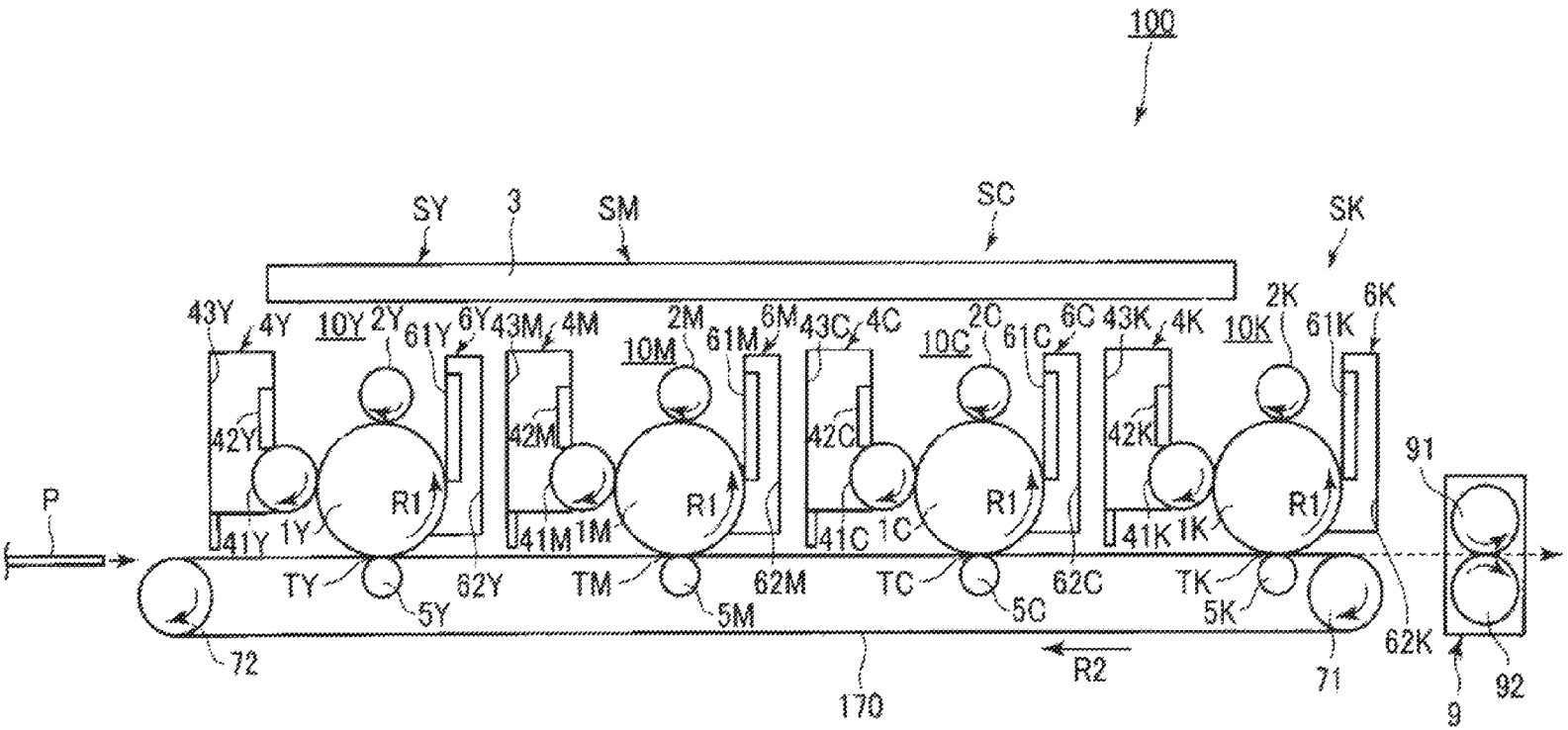
FIG. 7 is a schematic sectional view of a principal part of an image forming apparatus in another embodiment.

In the above-described embodiments, the image forming apparatus of the intermediate transfer type was described as an example, but the present invention is also applicable to an image forming apparatus of a direct transfer type. FIG. 7 is a schematic sectional view of a principal part of the image forming apparatus of the direct transfer type. In FIG. 7, elements having the same or corresponding functions or constitutions are represented by the same reference numerals or symbols. The image forming apparatus 100 in FIG. 7 includes, in place of the intermediary transfer belt 7, a recording material carrying belt 170 constituted by an endless belt as a recording material carrying member. The recording material carrying belt 170 is an example of a movable member for carrying and feeding the recording material onto which the images formed with the developers are to be transferred from the plurality of image bearing members. In the image forming apparatus 100 in FIG. 7, each of toner images formed on the photosensitive drums 1 at the image forming portions S is transferred onto the recording material P carried and fed on the recording material carrying belt 170. Also in such an image forming apparatus 100 of the direct transfer type, similarly as in the case of the image forming apparatus of the intermediary transfer type in the above-described embodiments, the contact opportunity between the photosensitive drum 1 and the developing roller 41 may desirably be reduced. Accordingly, the present invention is also applicable to the image forming apparatus of the direct transfer type, and effects similar to those in the above-described embodiments can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-024791 filed on Feb. 10, 2015 and 2016-005564 filed on Jan. 14, 2016, which are hereby incorporated by reference herein in their entirety.

What is claimed is:

1. An image forming apparatus comprising:

a plurality of image bearing members;

latent image forming means for forming a latent image on each of the image bearing members;

a plurality of developing units for developing the latent images on the image bearing members, wherein the developing units are provided correspondingly to the image bearing members, respectively, and include developing members movable toward and away from the image bearing members, respectively, and the latent images are capable of being formed on the image bearing members by contacting the developing members with the image bearing members, respectively;

a movable member onto which images obtained by developing the latent images with developers are transferred from the image bearing members;

a common driving source for driving the image bearing members;

a contact-and-separation unit for moving developing members toward and away from the image bearing members, respectively; and a control unit for outputting a signal for controlling the contact-and-separation unit, wherein the image forming apparatus is capable of forming the images in an operation in a mode in which the latent images are successively formed on the image bearing members and the images are successively transferred from the image bearing members onto the movable member, and wherein after end of the latent image formation on a final image bearing member of the plurality of image bearing members on which latent image formation is finally started and before end of transfer of an associated image from the final image bearing member, the control unit outputs a spacing signal for spacing associated developing members from other image bearing members of the plurality of image bearing members, during the image formation in the operation in the mode.

2. An image forming apparatus according to claim 1, wherein the other image bearing members include a plurality of the image bearing members, and wherein the contact and separation unit includes a first contact and separation mechanism for moving an associated developing member toward and away from the final image bearing member and a second contact and separation mechanism for moving associated developing members toward and away from the other image bearing members.

3. An image forming apparatus according to claim 2, wherein by the spacing signal, the second contact and separation mechanism spaces all of the associated developing members from the other image bearing members simultaneously.

4. An image forming apparatus according to claim 1, wherein the developing members are driven by the common driving source, and wherein after the spacing signal is outputted from the control unit, drive input from the common driving source into the developing members is eliminated.

5. An image forming apparatus according to claim 1, wherein the developing member associated with the final image bearing member and the movable member are driven by the common driving source.

6. An image forming apparatus comprising:

a plurality of image bearing members;

latent image forming means for forming a latent image on each of the image bearing members;

a plurality of developing units for developing the latent images on the image bearing members, wherein the developing units are provided correspondingly to the image bearing members, respectively, and include developing members movable toward and away from the image bearing members, respectively, and the latent images are capable of being formed on the image bearing members by contacting the developing members with the image bearing members, respectively;

a movable member for carrying and feeding a recording material onto which images obtained by developing the latent images with developers are transferred from the image bearing members;

a common driving source for driving the image bearing members;

a contact-and-separation unit for moving developing members toward and away from the image bearing members, respectively; and a control unit for outputting a signal for controlling the contact-and-separation unit, wherein the image forming apparatus is capable of forming the images in an operation in a mode in which the latent images are successively formed on the image bearing members and the images are successively transferred from the image bearing members onto the recording material carried on the movable member, and wherein after end of the latent image formation on a final image bearing member of the plurality of image bearing members on which latent image formation is finally started and before end of transfer of an associated image from the final image bearing member, the control unit outputs a spacing signal for spacing associated developing members from the other image bearing members of the plurality of image bearing members, during the image formation in the operation in the mode.

7. An image forming apparatus according to claim 6, wherein the other image bearing members include a plurality of the image bearing members, and wherein the contact and separation unit includes a first contact and separation mechanism for moving an associated developing member toward and away from the final image bearing member and a second contact and separation mechanism for moving associated developing members toward and away from the other image bearing members.

8. An image forming apparatus according to claim 7, wherein by the spacing signal, the second contact and separation mechanism spaces all of the associated developing members from the other image bearing members simultaneously.

9. An image forming apparatus according to claim 6, wherein the developing members are driven by the common driving source, and wherein after the spacing signal is outputted from the control unit, drive input from the common driving source into the developing members is eliminated.

10. An image forming apparatus according to claim 6, wherein the developing member associated with the final image bearing member and the movable member are driven by the common driving source.

11. An image forming apparatus comprising:

a plurality of image bearing members;

latent image forming means for forming a latent image on each of the image bearing members;

a plurality of developing units for developing the latent images on the image bearing members, wherein the developing units are provided correspondingly to the image bearing members, respectively, and include developing members movable toward and away from the image bearing members, respectively, and the latent images are capable of being formed on the image bearing members by contacting the developing members with the image bearing members, respectively;

a movable member onto which images obtained by developing the latent images with developers are transferred from the image bearing members;

a common driving source for driving the image bearing members; and a contact-and-separation unit for moving developing members toward and away from the image bearing members, respectively, wherein the image forming apparatus is capable of forming the images in an operation in a mode in which the latent images are successively formed on the image bearing members and the images are successively transferred from the image bearing members onto the movable member, and wherein after end of the latent image formation a final image bearing member of the plurality of image bearing members on which latent image formation is finally started and before end of transfer of an associated image from the final image bearing member, associated developing members are spaced from the other image bearing members of the plurality of image bearing members during the image formation in the operation in the mode.

12. An image forming apparatus according to claim 11, wherein the other image bearing members include a plurality of the image bearing members, and wherein the contact-and-separation unit includes a first contact-and-separation mechanism for moving an associated developing member toward and away from the final image bearing member and a second contact-and-separation mechanism for moving associated developing members toward and away from the plurality of the image bearing members of the other image bearing members.

13. An image forming apparatus according to claim 12, wherein the second contact-and-separation mechanism moves all of the associated developing members toward and away from the plurality of the image bearing members of the other image bearing members simultaneously.

14. An image forming apparatus according to claim 11, wherein the developing members of the developing units are driven by the common driving source, and wherein after the developing members are spaced from the image bearing members, drive input from the common driving source into the developing members is eliminated.

15. An image forming apparatus according to claim 11, wherein the developing member associated with the final image bearing member and the movable member are driven by the common driving source.

16. An image forming apparatus comprising:

a plurality of image bearing members;

latent image forming means for forming a latent image on each of the image bearing members;

a plurality of developing units for developing the latent images on the image bearing members, wherein the developing units are provided correspondingly to the image bearing members, respectively, and include developing members movable toward and away from the image bearing members, respectively, and the latent images are capable of being formed on the image bearing members by contacting the developing members with the image bearing members, respectively;

a movable member for carrying and feeding a recording material onto which images obtained by developing the latent images with developers are transferred from the image bearing members;

a common driving source for driving the image bearing members; and a contact-and-separation unit for moving developing members toward and away from the image bearing members, respectively, wherein the image forming apparatus is capable of forming the images in an operation in a mode in which the latent images are successively formed on the image bearing members and the images are successively transferred from the image bearing members onto the recording material carried on the movable member, and wherein after end of the latent image formation a final image bearing member of the plurality of image bearing members on which latent image formation is finally started and before end of transfer of an associated image from the final image bearing member, associated developing members are spaced from the other image bearing members of the plurality of image bearing members during the image formation in the operation in the mode.

17. An image forming apparatus according to claim 16, wherein the other image bearing members include a plurality of the image bearing members, and wherein the contact-and-separation unit includes a first contact-and-separation mechanism for moving an associated developing member toward and away from the final image bearing member and a second contact-and-separation mechanism for moving associated developing members toward and away from the plurality of the image bearing members of the other image bearing members.

18. An image forming apparatus according to claim 17, wherein by the spacing signal, the second contact-and-separation mechanism moves all of the associated developing members toward and away from the plurality of the image bearing members of the other image bearing members simultaneously.

19. An image forming apparatus according to claim 16, wherein the developing members of the developing unit are driven by the common driving source, and wherein after the developing members are spaced from the image bearing members, drive input from the common driving source into the developing members is eliminated.

20. An image forming apparatus according to claim 16, wherein the developing member associated with the final image bearing member and the movable member are driven by the common driving source.

* * * * *